United States Patent [19]

Grabietz

[11] Patent Number: 4,940,024

[45] Date of Patent: Jul. 10, 1990

[54] HOT WATER HEATER

[75] Inventor: Joachim Grabietz, Altgendorferstr. 41, Burgkirchen, Fed. Rep. of Germany, 8269

[73] Assignees: Hans Terhorst, Burghausen; Joachim Grabietz, Neuotting, both of Fed. Rep. of Germany

[21] Appl. No.: 210,604

[22] Filed: Jun. 23, 1988

[30] Foreign Application Priority Data

Jun. 24, 1987 [DE] Fed. Rep. of Germany ..... 3720900

[51] Int. Cl.[5] ..... F22B 5/00

[52] U.S. Cl. ..... 122/13 R; 122/13 A; 126/361

[58] Field of Search ..... 122/13 R, 13 A, 383; 126/361

[56] References Cited

U.S. PATENT DOCUMENTS

| | | | |
|---|---|---|---|
| 1,779,937 | 10/1930 | Holinger | 122/13 A |
| 1,855,077 | 4/1932 | Wildt | 122/13 R |
| 2,041,630 | 5/1936 | Wright | 122/13 A |
| 2,151,854 | 3/1939 | Knapp | 122/13 A |
| 3,521,604 | 7/1970 | Nickel | 122/13 A |
| 4,505,231 | 3/1985 | Syler | 122/383 X |

FOREIGN PATENT DOCUMENTS

| | | |
|---|---|---|
| 2550581 | 11/1975 | Fed. Rep. of Germany . |
| 3012590 | 4/1980 | Fed. Rep. of Germany . |
| 3525990 | 7/1985 | Fed. Rep. of Germany . |
| 3641726 | 12/1986 | Fed. Rep. of Germany . |
| 1299281 | 1/1961 | France . |

OTHER PUBLICATIONS

Patent Abstracts of Japan, vol. 10, No. 81 (M-465) (2138) re: Application No. 60-221656.

European Search Report EP 88 11 0150 pertaining to Applicant's European Patent Application on the present invention.

*Primary Examiner*—Edward G. Favors

*Attorney, Agent, or Firm*—Townsend and Townsend

[57] ABSTRACT

The formation of bacteria and germs, in particular of legionella during the heating of hot water is prevented by the special cold water outlet inside the hot water heater. In this hot water heater the entire cold water consumption is directed through the hot water heater. At the same time the pressure level in the cold water system and in the hot water system is also the same, whereby the disadvantage of fluctuating mixing temperatures for the consumer is avoided, i.e. at the point of use.

9 Claims, 1 Drawing Sheet

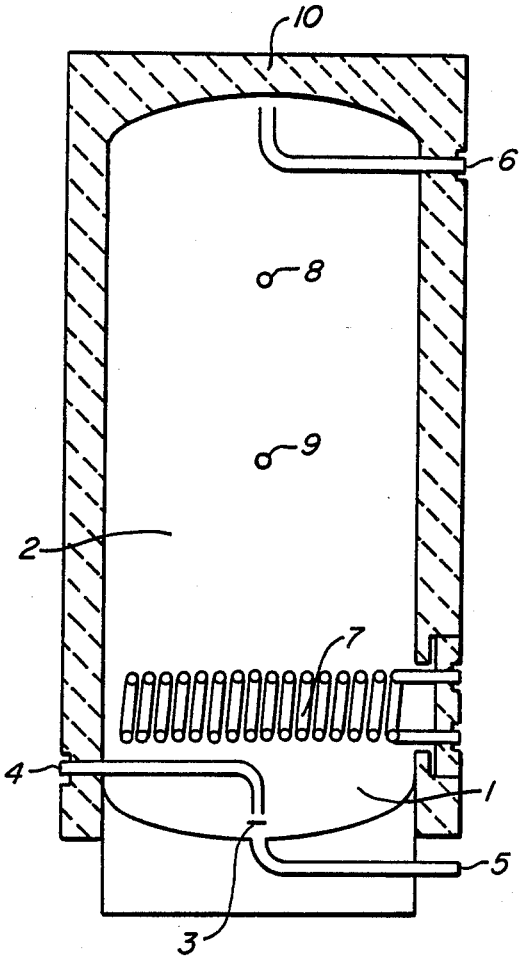
10
6
8
9
2
7
4
1
5
3

HOT WATER HEATER

The invention relates to a hot water heater comprising a storage tank or container through which water flows, a cold water inlet in the lower region of the container, a hot water outlet in the upper region of the container and a heating element arranged in the storage container.

It is known that in systems for the drinking water supply and in particular in systems for hot water supply the danger exists of germs and bacteria occurring which can lead to infectious diseases. Particularly dangerous are so-called legionella or legionaries' bacteria which can for example be inhaled during showering and can lead to perilous infections which are a danger to life.

The formation and multiplication of such legionella is not only promoted by the temperature in the customary hot water systems, but rather also by the fact that dead spaces are present in such systems in which deposits and sediment formation can arise, which in turn represent a culture medium for bacteria and can in particular accelerate the multiplication of legionella.

It is also known that the prevailing water temperature has an important effect on the multiplication of bacteria, with a temperature range between 32° C. and 42° C. being considered ideal for such undesired bacterial multiplication. A temperature of approximately 25° C. represents a lower limit for the bacterial multiplication whereas at a temperature above 80° C. the bacteria die.

A storage water heater for domestic hot water is known from DE-OS 35 25 990 having a lower domestic water inlet and an upper domestic water outlet, and also a thermostat for controlling the heating, wherein, for the purpose of rendering bacteria present in the water innocuous, the thermostat is arranged in the upper region of the storage container and is set to a switching temperature around 80° C.

This measure is intended to ensure that in the upper region of the storage container heating of the water for domestic use to temperatures around 80° C., at which the noxious bacteria are killed off, is guaranteed in this zone. The problem of bacterial multiplicaton can admittedly be countered through the heating up of all the domestic water which is drawn off to values around 80° C., which is associated with a corresponding consumption of energy, however, this solution is on the one hand not suitable for the many low temperature systems which are in use and, on the other hand, it does not prevent bacterial multiplication in sludge deposits in the base region of the domestic water storage container, so that the danger of bacteria being introduced into the domestic water still exists, for example when the temperature in the upper region of the container drops substantially due to a malfunction.

The objection underlying the invention is to avoid the formation and multiplication of bacteria in a hot water heater of the initially named kind, in particular of legionella, using simple measures which do not lead to additional consumption of energy, and above all to preclude the danger arising from deposits and sediment formation in dead spaces.

This object is satisfied in accordance with the invention in that a cold water outlet is provided in the lower region of the container.

In this manner all the cold water which is consumed is directed through the specially endangered lower region of the container and ensures that no standing hot water and no deposits can form, whereby any form of culture medium for the bacteria is avoided and thus bacterial growth is prevented.

In accordance with a particularly preferred embodiment the cold water inlet is directed onto the base of the storage container by means of a pipe bend in the lower container region. It is particularly advantageous if a deflecting part is arranged in front of the outlet opening of the cold water inlet in the storage container.

Moreover, the cold water outlet is preferably arranged beneath the deflecting part at the base of the storage container, while the heating element is arranged above the lower region of the container.

An embodiment of the invention will now be explained in more detail with reference to the drawing, the single FIGURE of which shows a schematic longitudinal sectional view of a hot water heater in accordance with the invention.

In a storage container hot water is generated in an upper container region 2 above a heating element 7 and cannot sink into the cold water region formed by the lower container region 1, due to the different densities of cold water and hot water. Mixing of the cold and hot water is not possible due to the low throughflow speed of the two media.

By arranging the cold water inlet 4 and the cold water outlet 5 in the lower region of the container 1 the endangered lower region of the container is always flushed with fresh water, i.e. fresh water always flows through it, so that no sludge formation can occur.

The cold water inlet 4 is formed by a curved pipe which opens opposite to a sheet metal impact plate. In this manner a particularly effective flushing of the endangered base of the container is ensured.

The entire quantity of the cold water consumed is directed through the illustrated hot water heater, however with the hot water also being generated at the same time. As a result the pressure level in the cold water region and in the hot water region is the same, whereby fluctuating mixing temperatures for the user are avoided, i.e. at the point of use.

The hot water heater, which is jacketed with insulation 10, is equipped in the customary manner with a thermostat 9 which makes it possible to regulate the hot water temperature to the desired value, in particular to approximately 60°. In the customary manner a thermometer 8 is provided for visual checking of the prevailing temperature.

I claim:

1. Hot water heater comprising a storage container having means through which hot and cold water flows for consumption by separately withdrawing hot and cold water from the container, a cold water inlet in the lower region of the container, a hot water outlet in the upper region of the container, a heating element arranged in the storage container, and a cold water outlet provided in the lower region of the container through which outlet cold water flows, said cold water outlet being for connection to a cold water domestic supply.

2. Hot water heater comprising a storage container through which hot and cold water flows for consumption by separately withdrawing hot and cold water from the container, a cold water inlet in the lower region of the container including a pipe bend for directing flow from said cold water inlet to the lower region of the container, a hot water outlet in the upper region of the container, a heating element arranged in the storage container, and a cold water outlet provided in the lower region of the container through which outlet cold water flows, said cold water outlet being for connection to a cold water domestic supply.

3. Hot water heater in accordance with claim 1, characterised in that a deflecting part (3) is arranged in the storage container in front of the outlet opening of the cold water inlet (4).

4. Hot water heater in accordance with claim 2, characterised in that a deflecting part (3) is arranged in the storage container in front of the outlet opening of the cold water inlet (4).

5. Hot water heater in accordance with claim 1, characterised in that the heating element (7) is arranged above the lower container region (1).

6. A hot water heater, comprising:

a storage container through which water flows, said container including upper and lower regions;

a cold water inlet in the lower region of said storage container;

a deflecting part, disposed in said storage container in front of an outlet opening of said cold water inlet;

a hot water outlet in the upper region of said storage container;

a heating element arranged in said storage container; and a cold water outlet, disposed beneath said deflecting part at a base of said storage container.

7. A hot water heater, comprising:

a storage container through which water flows, said container including upper and lower regions;

a cold water inlet in the lower region of said storage container, said inlet being directed towards a base of said storage container by a pipe bend in the lower region of said storage container;

a deflecting part, disposed in said storage container in front of an outlet opening of said cold water inlet;

a hot water outlet in the upper region of said storage container;

a heating element arranged in said storage container; and a cold water outlet, disposed in the lower region of said storage container.

8. A hot water heater according to claim 6, wherein said heating element is disposed above the lower region of said storage container.

9. A hot water heater according to claim 7, wherein said heating element is disposed above the lower region of said storage container.

* * * * *